US005673740A

United States Patent [19]

Park

[11] Patent Number: 5,673,740

[45] Date of Patent: Oct. 7, 1997

[54] SHUTTER EQUIPMENT FOR A BUILDING

[75] Inventor: Kap-Il Park, 47-22, Okin-dong, Chongro-ku, Seoul, 110-035, Rep. of Korea

[73] Assignees: Kap-Il Park; Ji-Sung Park, both of Seoul, Rep. of Korea

[21] Appl. No.: 542,271

[22] Filed: Oct. 12, 1995

[30] Foreign Application Priority Data

Oct. 14, 1994 [KR] Rep. of Korea ..... 26781
Aug. 25, 1995 [KR] Rep. of Korea ..... 22218

[51] Int. Cl.[6] ..... E06B 3/48

[52] U.S. Cl. ..... 160/116; 160/133; 160/180

[58] Field of Search ..... 160/116, 180, 160/133, 185, 186, 187

[56] References Cited

U.S. PATENT DOCUMENTS

| | | | |
|---|---|---|---|
| 888,862 | 5/1908 | Wilson | 160/116 |
| 1,961,674 | 6/1934 | Moss | 160/116 |
| 1,989,657 | 1/1935 | McCloud | 160/116 |
| 1,989,658 | 1/1935 | McCloud | 160/116 |
| 2,017,012 | 10/1935 | Morgan | 160/116 |
| 3,090,424 | 5/1963 | Carlo | 160/116 |
| 3,489,200 | 1/1970 | Recchione | 160/133 |
| 3,717,194 | 2/1973 | Gerken | 160/133 X |
| 3,756,137 | 9/1973 | Scharres | 160/133 X |
| 3,927,709 | 12/1975 | Anderson et al. | 160/116 X |
| 4,383,569 | 5/1983 | Labelle | 160/116 |
| 4,467,853 | 8/1984 | Downey, Jr. | 160/133 |
| 4,603,723 | 8/1986 | Sugihara | 160/116 X |
| 5,205,336 | 4/1993 | Munekata et al. | 160/133 |
| 5,284,199 | 2/1994 | Finch et al. | 160/133 |
| 5,377,738 | 1/1995 | Cooper | 160/133 |

*Primary Examiner*—Kenneth J. Dorner
*Assistant Examiner*—Bruce A. Lev
*Attorney, Agent, or Firm*—Morrison Law Firm

[57] ABSTRACT

A shutter with an emergency exit has blocks attached to it. The projection of the blocks from the shutter match the projection of hinges that hold the emergency exit, such that the shutter winds evenly around a drum in a shutter box. The shutter also has reinforced horizontal shutter materials directly above and directly below the emergency exit to keep the shutter horizontally balanced as the shutter is wound into or out of the shutter box. The shutter also includes shock absorbing material where the emergency exit and the shutter meet. The shock absorbing material reduces noise from the contact of the emergency exit and the shutter and also prevents smoke from transferring from one side of the shutter to the other.

13 Claims, 9 Drawing Sheets

SHUTTER EQUIPMENT FOR A BUILDING

BACKGROUND OF THE INVENTION

The present invention relates to an improved shutter equipment. The shutter connects and sets up to move freely with horizontal shutter materials having equal top and bottom widths. A shutter box includes means for winding the shutter up or unwinding the shutter down. The shutter box also includes guide rails set up at both sides of the shutter for guiding the ascent and descent motion of the shutter.

This kind of shutter equipment used in the building and the car shed has been introduced in the Korea Utility Model Public Notice No. 95-6476 and Japan Utility Model Public Notice No. Pyoung 6-40292 as a prior art of the present inventor, and the present invention is more improved than the shutter equipment of prior art.

In order to promote understanding of the present invention, the construction outline of the prior art shutter equipment is briefly explained using FIG. 1 and FIG. 2. Referring to FIGS. 1 and 2, the shutter equipment of prior art comprises a shutter 1 having plural horizontal shutter materials 1*a*, 1*b*, connected and set up so as to move freely around. The plural horizontal shutter materials 1*a* and 1*b* have equal top and bottom widths. A shutter box 2 has means for winding shutter 1 up or unwinding shutter 1 down and guide rails 3 and 4, set up at both sides of shutter 1, guide the ascent and descent motion of shutter 1. An emergency exit 5 is set up to be wound into shutter box 2 or to be unwound to the outside of shutter box 2 with the shutter 1. Therefore, emergency exit 5 is set up to move freely around with shutter materials 1*a* and 1*b* with which shutter 1 is formed. Exit shatter materials 5*a* of equal top and bottom widths at top and bottom stepped parts 1*b*' of each shutter material 1*b*, is attached to shutter materials 1*b* of shutter 1 with hinges 6 as shown in FIG. 1 and therefore connected to shutter 1.

In the shutter equipment of prior art, hinges 6 connecting shutter 1 and emergency exit 5 are a bracket type hinge. Hinges 6 each have an axis 6*a* at the connection of shatter materials 1*b* and exit shatter materials 5*a*. As shutter 1, including the emergency exit 5, are wound up around a drum in shutter box 2, the axes 6*a* are higher in height than the front and rear heights of shutter I and emergency exit 5. Shutter materials 1*b* and exit shatter materials 5*a* of both sides of the hinge 6 are wound onto a winding box or drum (not shown) of the inner part of the shutter box 2. Due to a different slack displacement between the shutter materials 1*b* and exit shatter materials 5*a*, due to the higher height at hinges 6, a winding unbalance of shutter 1 occurs where the emergency exit 5 is connected. Accordingly, there is the problem that the variation of shutter 1 or a restraint of the ascent and descent motion is exhibited. Also, in the shatter equipment of the prior art, as the emergency exit 5 is opened when shutter 1 is taken down (as shown in FIG. 1), emergency exit 5 leans to one side remarkably. The leaning of emergency exit 5 is due to a variation, which is apt to occur at the part of shutter 1 supporting emergency exit 5, because there is no means for preventing the slack displacement through hinges 6 at the part of shutter I supporting emergency exit 5, in the opened direction of emergency exit 5.

And also, the shutter equipment of the prior art allows smoke to pass through the openings around emergency exit 5 at the upper stepped part 5*a* and the lower stepped part 5*a* of the emergency exit, and in case of fire, human life is suffocated due to smoke.

OBJECTS AND SUMMARY OF THE INVENTION

The object of the present invention is to provide a shutter apparatus which overcomes all problems of the prior art.

The above object is to be fully equipped with a means for clearing up the winding unbalance against the winding drum of the shutter box, owing to the hinges connecting the emergency exit, at a suitable place where the emergency exit of the shutter body is set up. The present invention in the above typed shutter equipment, also includes means for preventing the occurrence of slack displacement, which the shutter body part supporting the emergency exit causes in the opened direction of the emergency exit, as the said emergency exit is opened, and the same time, in case of the opening and shutting of the emergency exit. Slack absorbing means for cutting off smoke to so as to intercept the shock absorption and the outflow of smoke, is also connected to emergency exit 5.

Briefly stated, a shutter with an emergency exit has a plurality of blocks attached to it. The projection of the blocks from the shutter match the projection of hinges that hold the emergency exit, such that the shutter winds evenly around a drum in a shutter box. The shutter also has reinforced horizontal shutter materials directly above and directly below the emergency exit to keep the shutter horizontally balanced as the shutter is wound into or out of the shutter box. The shutter also includes shock absorbing material where the emergency exit and the shutter meet. The shock absorbing material reduces noise from the contact of the emergency exit and the shutter and also prevents smoke from transferring from one side of the shutter to the other.

According to an embodiment of the present invention, there is described, a shutter apparatus comprising: a shutter having plural horizontal shutter materials having the same top and bottom widths, a shutter box equipped with the means for winding up or unwinding down said shutter, a guide rail set up at both sides of said shutter and guiding the ascent and descent motion of said shutter, an emergency exit set up through hinges at one side of a suitable part of said shutter to ascent and descent with said shutter, said shutter apparatus for a building including means for eliminating a winding unbalance in the shutter box owing to hinges connecting said emergency exit to said horizontal shutter materials, means for preventing a slack displacement in said shutter materials connected to said emergency exit, occurring in the opened direction of emergency exit as opening said emergency exit, and shock absorbing means for cutting off smoke at an upper stepped part and a one end part, and a bottom of said shutter part making contact with said emergency exit.

According to another embodiment of the present invention, there is described, a shutter apparatus comprising: a plurality of shutter materials, an emergency exit attached to some of said shutter materials by hinges, a shutter box including means for winding said shutter around a drum in said shutter box, blocks attached to said some of said shutter materials, a projection of said blocks out of said shutter matching another projection of said hinges such that said shutter winds evenly around said drum, means for maintaining the shutter horizontally even as said shutter is wound around said drum, and shock absorbing material placed where said emergency exit contacts said shutter whereby noise is reduced and smoke is prevented from infiltrating the shutter.

In the preferred embodiment, the means for clearing up the winding unbalance owing to the emergency exit institution of the said shutter, is comprised of plural blocks attached to the suitable place of the said shutter body so as to have the same projection height as the projection height from the shutter materials of the hinges for instituting the said emergency exit.

In the preferred embodiment, the means for preventing the occurrence of slack displacement, which the emergency exit installation part of the said shutter body causes in the opened direction of the emergency exit as the said emergency exit is opened, has the length for covering the whole width of the shutter, and is welded to the bottommost shutter material of the shutter body for supporting the said emergency exit and comprised with a bottom bar so that the both sides are inserted in and supported at the guide rail of the both sides of the shutter body.

DETAILED DESCRIPTION OF THE DRAWINGS

Figure 1:
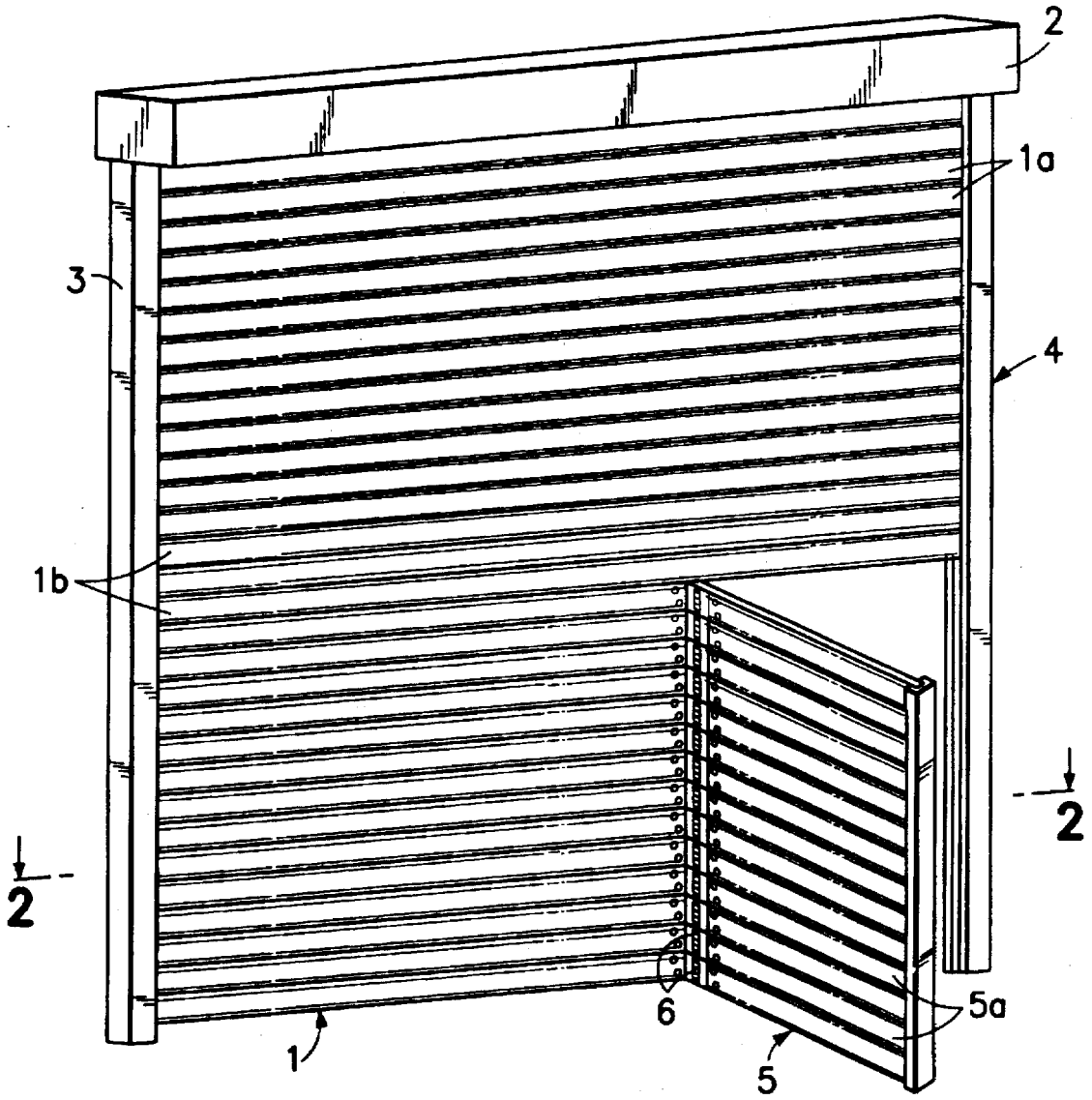
FIG. 1 PRIOR ART
FIG. 1 is a perspective view of the shutter equipment of the prior art concerning the present invention.
Figure 2:
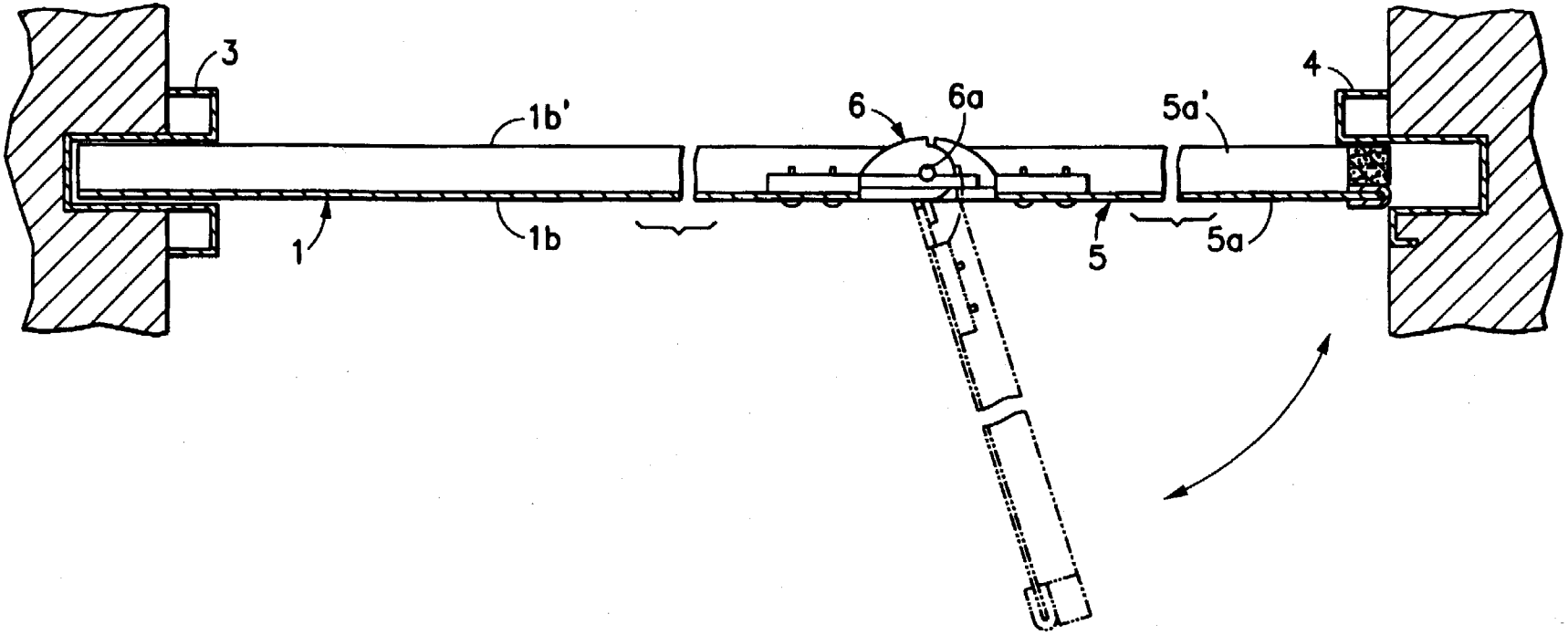
FIG. 2 PRIOR ART
FIG. 2 is a cross section on the line A—A shown in FIG. 1.

The present invention is explained in more detail referring to the attached drawings.

FIGS. 3–6 show the shutter equipment in accordance with the preferred embodiment of the present invention. The shutter equipment of the present invention as shown here comprising the same basic constituent elements as the shutter equipment of the detailed prior art. Namely, a shutter i connected and set up to move freely around with the plural horizontal shutter materials 1*a* and 1*b* having equal top and bottom widths. A shutter box 2 includes means for winding up or unwinding down shutter 1. Guide rails 3 and 4 for guiding the ascent and descent motion of shutter 1 are set up at both sides of shutter 1, and an emergency exit 5 is set up through hinges 6 at a suitable place of shutter 1. Hinges 6 each have an axis 6*a* at the connection of shutter materials 1*b* and exit shutter materials 5*a*. Exit shutter materials 5*a* have upper and lower stepped parts 5*a*' of equal lengths corresponding to top and bottom stepped parts 1*b*' of each shutter material 1*b*. Exit shutter materials 5*a* are attached to shutter materials 1*b* with hinges 6.

According to the present invention, in shutter 1, blocks 7 attach at suitable places on shutter materials 1*b*, such that the projecting height of shutter materials 1*b* is the same as the projecting height of the shutter material of hinges 6 in the center parts, as shutter 1 is wound up into shutter box 2.

Figure 3:
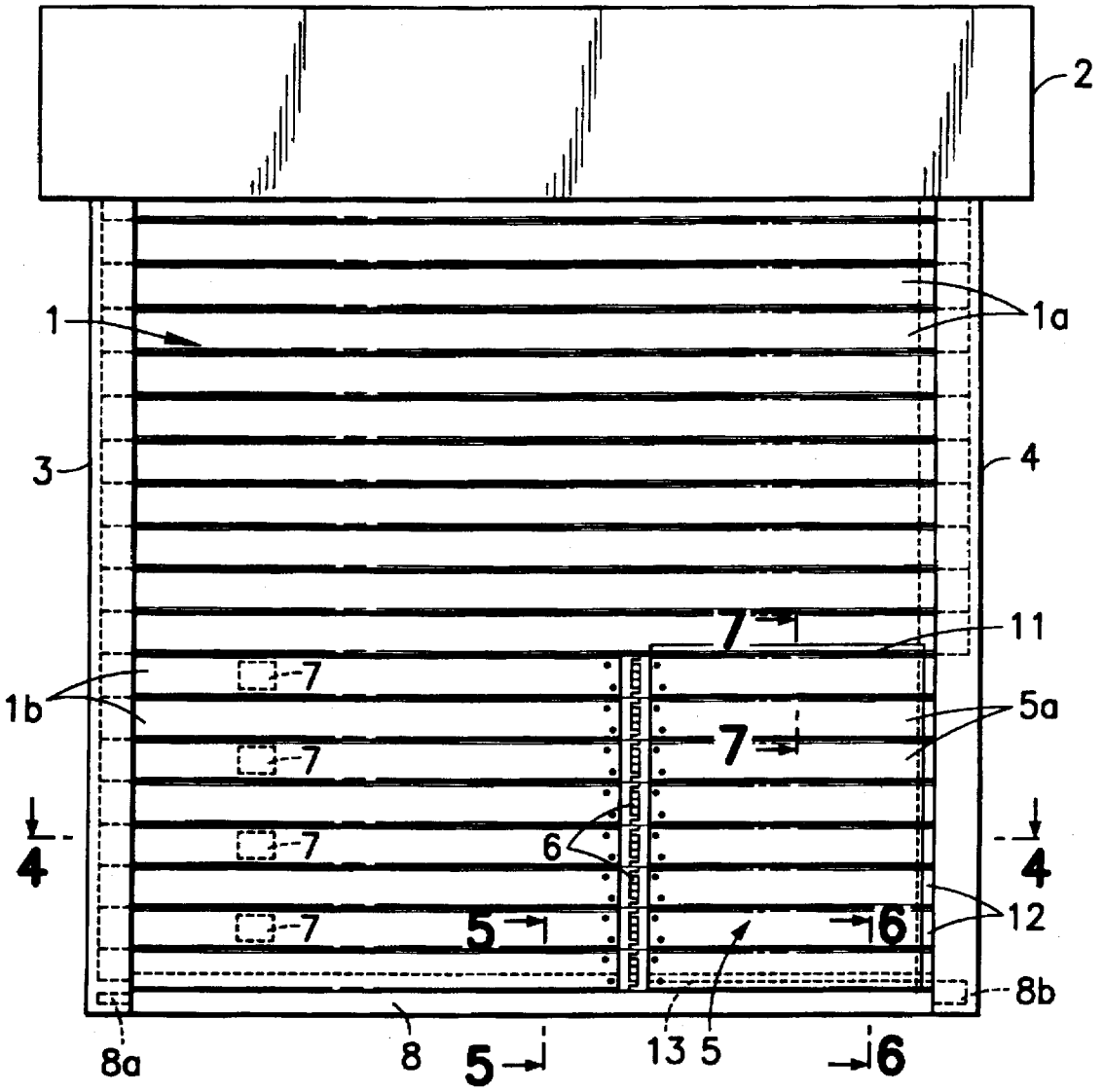
FIG. 3 is a front view showing the shutter equipment of the present invention.
Figure 4:
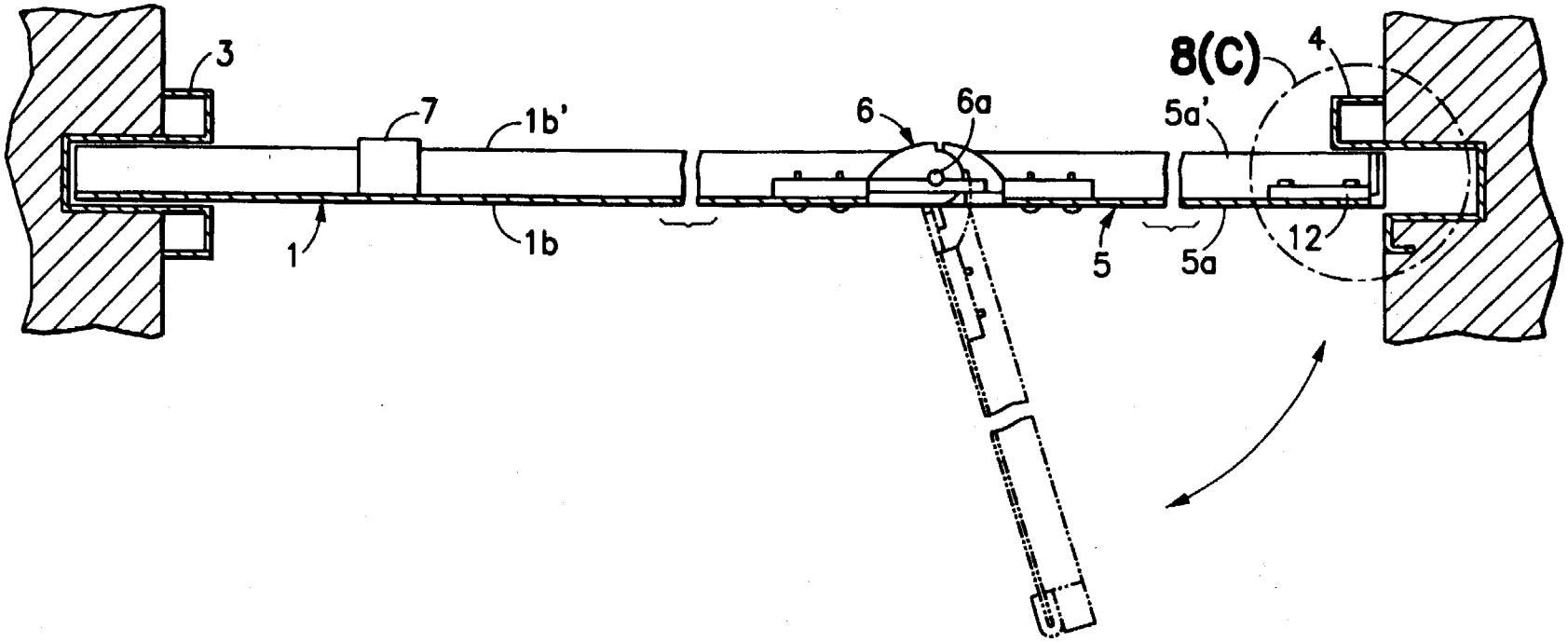
FIG. 4 is cross section on the line B—B shown in FIG. 3.

Exit shutter materials 5*a* of emergency exit 5 are supported through hinges 6 and have a short length compared to shutter materials 1*b*. The shutter materials 1*b* of shutter 1, at the height corresponding with exit shutter materials 5*a* of emergency exit 5, have a remarkably longer length than exit shutter materials 5*a* of emergency exit 5. Accordingly, the winding unbalance in shutter box 2, as mentioned above, occurs in shutter materials 1*b* of shutter 1 because shutter materials 1*b* have a longer length than exit shutter materials 5*a*. At the same time, because of the short lengths of exit shutter materials 5*a*, the winding unbalance in the said shutter box 2 is barely noticeable in shutter materials 5*a* of emergency exit 5. Therefore, the winding unbalance in shutter box 2, owing to hinges 6 is sufficiently eliminated by blocks 7 installed at the suitable place of shutter materials 1*b* where emergency exit 5 of shutter 1 is connected, as is illustrated in FIG. 3. Blocks 7 are installed one by one at all shutter materials 1*b* where emergency exit 5 of shutter 1 is connected. However, as an alternative, if blocks 7 have been installed in 2 by 2 intervals at shutter materials 1*b*, the expected results can be achieved. This is the reason why shutter materials 1*b* where blocks 7 are not connected, create the same winding motion following the up and down motion of shutter materials 1*b* where blocks 7 are connected, because all shutter materials 1*b* are connected up and down.

In the shutter equipment according to the present invention with blocks 7, as emergency exit 5 is opened, the means for preventing the slack displacement that shutter part 1 supporting the emergency exit 5, occurring in the opened direction of the said emergency exit 5, is also connected.

Figure 5:
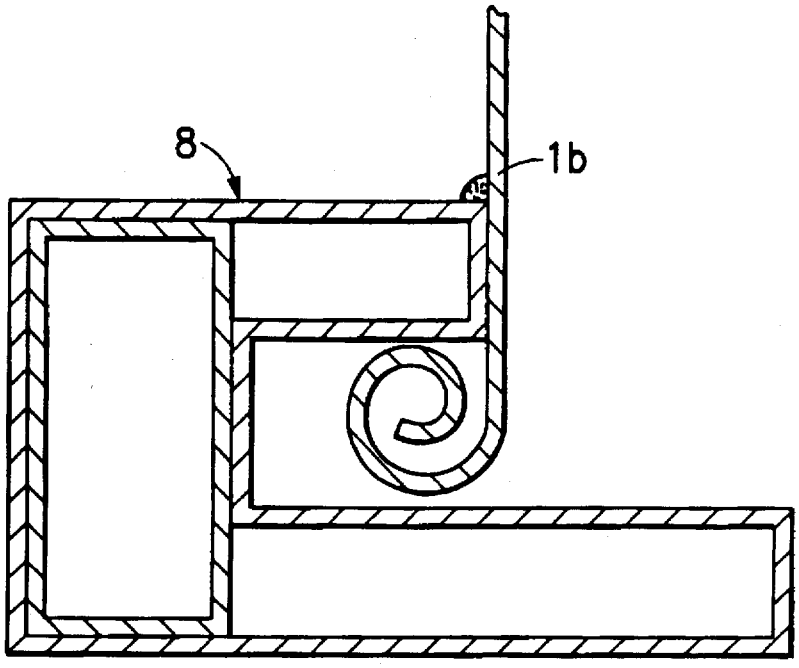
FIG. 5 is a partly enlarged scale cross section on the line C—C shown in FIG. 3.
Figure 6:
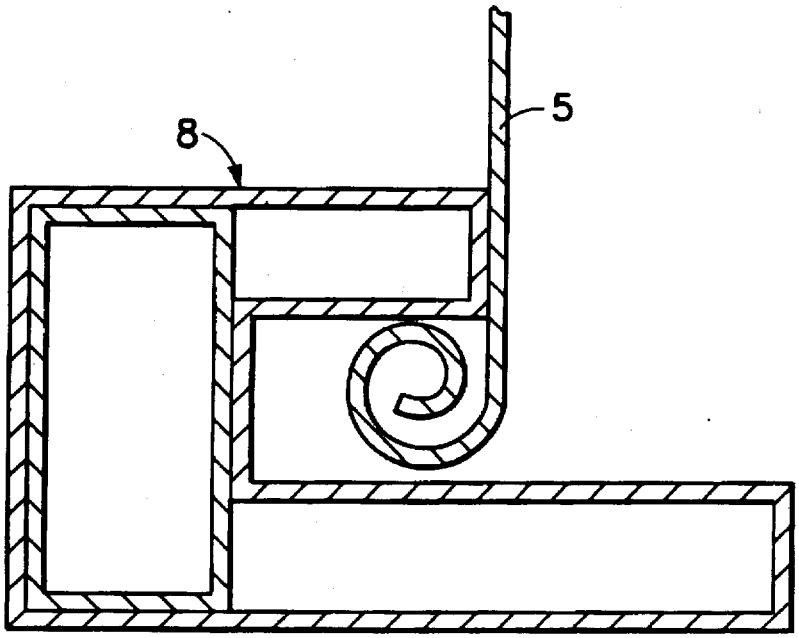
FIG. 6 is a partly enlarged scale cross section on the line D—D shown in FIG. 3.

As a desirable illustration of the means for preventing the slack displacement, the present invention includes a bottom bar 8 connected to the bottommost shutter material of shutter materials 1*b* supporting emergency exit 5, as shown in FIGS. 3 and 5. This bottom bar 8 has the length which is able to cover the whole width of shutter I and includes a sectional form for providing greater bending resistance than shutter materials 1*a* and 1*b*. The prolongation parts 8*a* and 8*b* of the both ends of bottom bar 8 are inserted into guide rails 3 and 4, respectively and set up at the lower end of the said shutter materials 1*b* by welding. To facilitate opening and shutting emergency exit 5, exit shutter materials 5*a*, forming emergency exit 5, are not fixed to bottom bar 8 with welding, as depicted in FIG. 6. By setting up the bottom bar 8 like this, the shutter equipment of the present invention can prevent the slack displacement of shutter materials 1*b* supporting emergency exit 5 in the opened direction of emergency exit 5, if emergency exit 5 is opened due to great stress. The emergency exit 5 is connected between bottom bar 8 and shutter materials 1*a* of the upper part of shutter 1. Both ends of bottom bar 8 are inserted into guide rail 3 and 4. Referencing FIGS. 3 and 7, a stopper board for reinforcement 11*a*, is fixedly attached at the upper part of emergency exit 5 with shock-absorbing material 11*b*. Breakage of shutter 1 and emergency exit 5 can be protected against without shock to shutter 1 as emergency exit 5 is closed.

Figure 7:
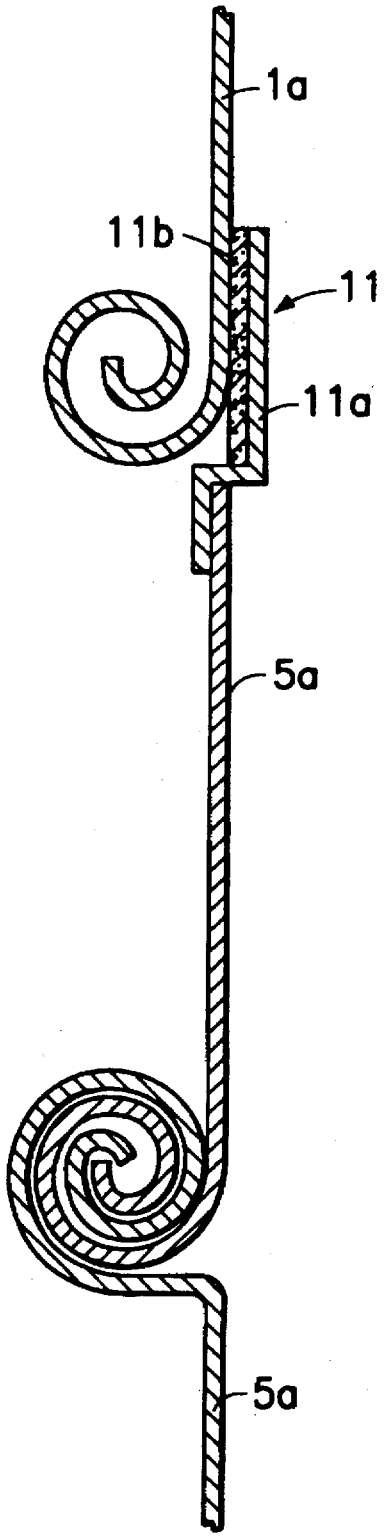
FIG. 7 is a cross section on the line E—E of FIG. 3 showing the instituted state of a shock absorbing means for cutting off smoke set up the upper stepped part of the emergency exit according to the present invention.
Figure 8A:
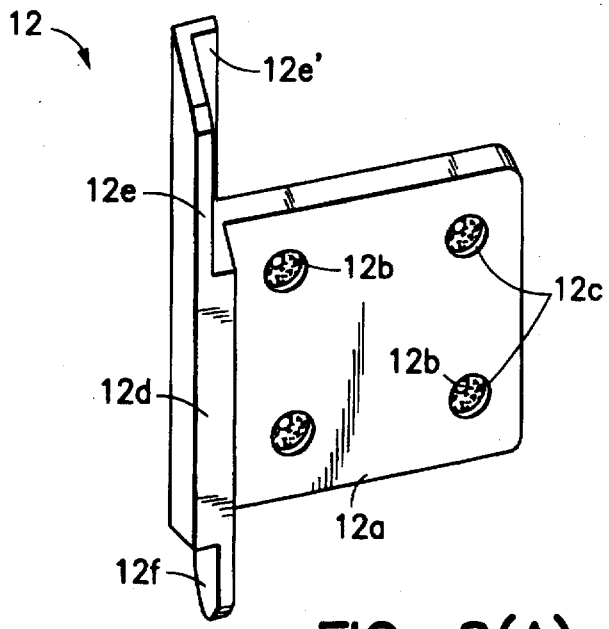
FIG. 8(A) is a perspective view of the shock absorbing means for cutting off smoke according to the present invention set up at the one stepped part of the emergency exit.
Figure 8B:
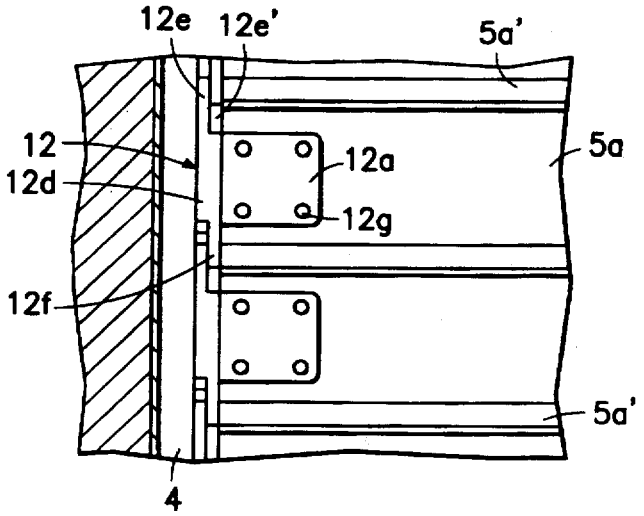
FIG. 8(B) is a back view showing a state which the shock absorbing means for cutting off smoke is set up at the emergency exit.
Figure 8C:
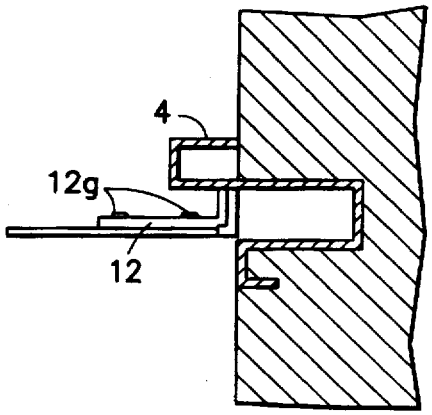
FIG. 8(C) is an enlarged scale showing the instituted state of the shock absorbing means for cutting off smoke.

As in FIG. 7 of the preferred embodiment of the shock absorbing means for cutting off smoke 11 connecting to emergency exit 5, shock absorbing means for cutting off smoke 11 equipped with the stopper board for reinforcement settled of the shock absorbing material is attached at the upper end part of emergency exit 5 with welding or a fastening tool 12*g* (shown in FIG. 8*b* and 8*c*) to absorb the shock and to reinforce the upper end part of emergency exit 5 to reduce the shock of opening and shutting emergency exit 5. The shock of emergency exit 5 against shutter materials 1*a* is buffered, and at the same time the noise is decreased. In case of fire, the occurring smoke is intercepted. Referring now also to FIGS. 8(A), 8(B), and 8(C), a reinforcement material 12*b* is laid into the one end part of emergency exit shutter materials 5*a*, opposite hinges 6, to reinforce the strength of the shock absorbing means for cutting off smoke 12, which is molded of rubber or synthetic resins. Plural holes 12*c* are formed in a fixed board 12*a* to attach shock absorbing means for cutting off smoke 12; with the fastening tool 12*g* such as a bolt or a screw, to exit shutter materials 5*a*. In the one end part of fixed board 12*a*, the occurring smoke in case of fire is prevented from flowing into the other zone. As opening and shutting emergency exit 5, an edge(end) part 12*e* is formed at the upper part in being vertically dug so as not to be interfered with the interior part for cutting off smoke 12*f*, of an upwardly adjacent means for cutting off smoke, to absorb the shock. The exterior part for cutting off smoke 12*e*' is formed at the one end part 12*e* in the form of a hook as depicted in FIGS. 8(A) and 8(B).

Figure 9A:
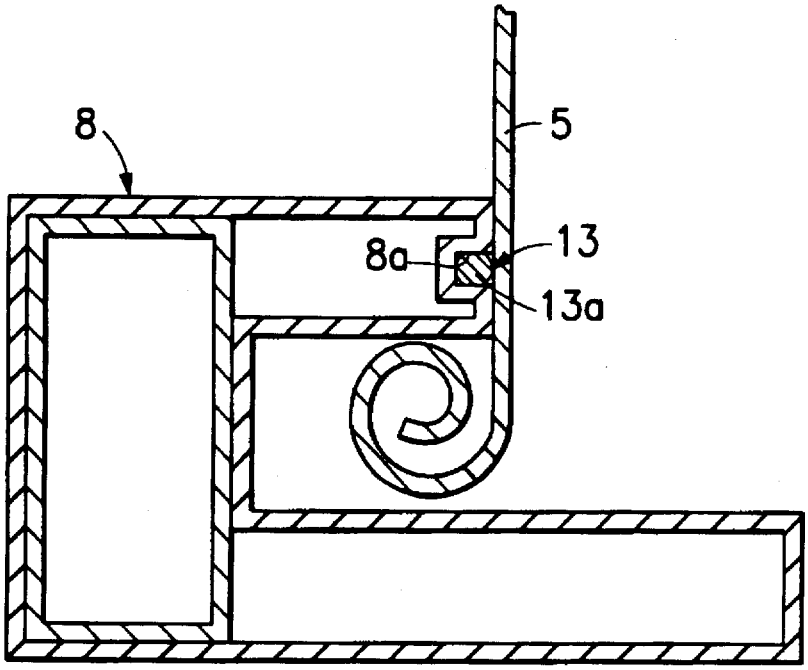
FIG. 9(A) is a cross section D—D of FIG. 3 of a state which the shock absorbing means for cutting off smoke is set up at the bottom bar of the lower part of the emergency exit according to the present invention.
Figure 9B:
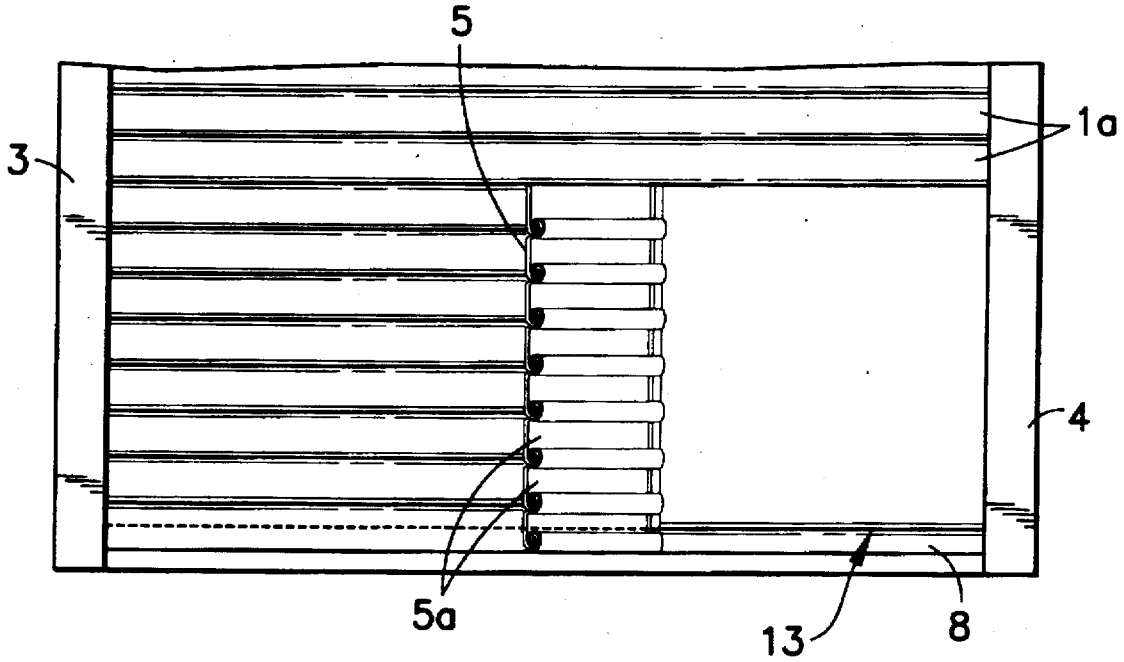
FIG. 9(B) is a front view showing a state which the shock absorbing means for cutting off smoke of the other illustration is set up at the bottom bar of the lower part of the emergency exit according to the present invention.

In the lower part of shock absorbing means for cutting off smoke 12, shock absorbing part for cutting off smoke 12*d* forming the interior part for cutting off smoke 12*f* is molded and at the same time, perpendicular to the one end part of fixed board 12*a*. Interior part 12*f* is coated with the said reinforcement material in being given a slope to the external part and dug so as not to be interfered with the exterior part for cutting off smoke 12*e*', of a downwardly adjacent means for cutting off smoke 12. Therefore, the smoke through the aperture of the emergency exit 5 is intercepted and the shock of opening and shutting the emergency exit is absorbed. Referring now to FIGS. 9(A) and 9(B), an inserting groove 8*a* is formed to receive the shock-absorbing material for cutting off smoke 13*a* in bottom bar 8 horizontally. Shock absorbing means for cutting off smoke 13 inserted with the shock-absorbing material for cutting off smoke 13*a* made of the rubber shock-absorbing material is set up to the bottom bar 8 of the part made contact with emergency exit 5. As opening and shutting the emergency exit 5, the shock is absorbed and at the same time, the noise is reduced, and in case of fire, the smoke-inflow can be intercepted and the death from suffocation owing to the smoke can be prevented. At the same time, the noise of the emergency exit can be greatly reduced.

Figure 10:
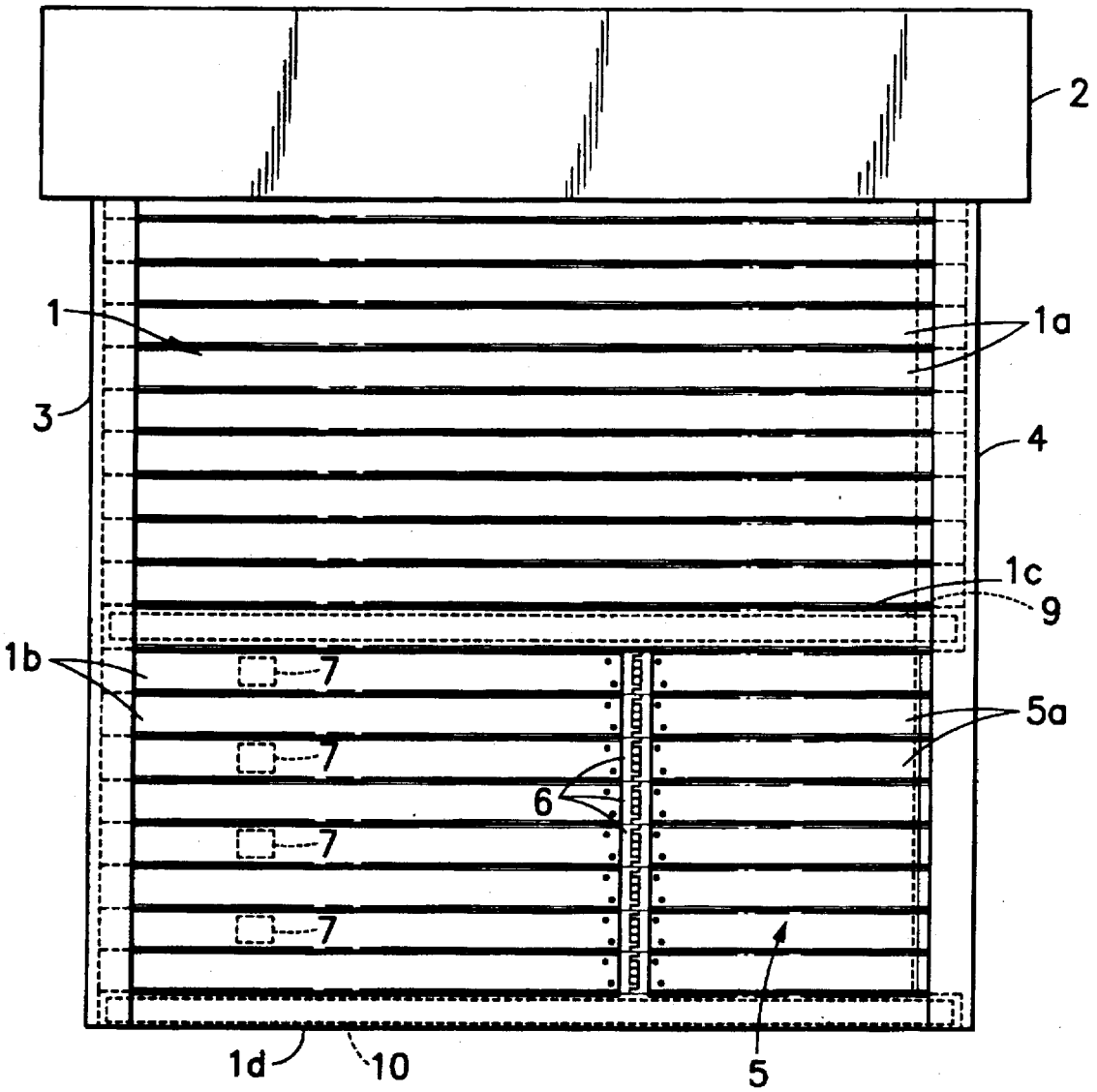
FIG. 10 is a front view showing the shutter equipment according to another embodiment of the present invention.

In the other possible alternative, as in FIG. 10, the shutter equipment is more equipped with one or two shutter materials set up at the lower part of emergency exit 5, and the reinforcement materials 9 and 10 providing the necessary bending strength of the shutter material 1*d* and shutter material 1*c* of emergency exit 5, are attached. As opening and shutting the emergency exit 5, shutter 1, connected with emergency exit 5, prevents the slack displacement which the shutter materials supporting emergency exit 5, occurring in the opened direction of the emergency exit 5, by the working of the shutter materials 1*c* and 1*d* attached with the said reinforcement materials 9 and 10.

What is claimed is:

1. A shutter apparatus comprising:

a shutter having a plurality of vertically coupled horizontal shutter materials, each of said horizontal shutter materials having equal top and bottom widths;

a shutter box equipped with the means for winding said shutter into and out of said shutter box;

a guide rail set up at both sides of said shutter and guiding an ascent and descent motion of said shutter;

an emergency exit at one side of a suitable part of said shutter to ascent and descent with said shutter;

hinges connecting said emergency exit to said shutter such that said emergency exit pivots about said hinges between an open position and closed position;

a block attached between ends of said shutter materials to correct a winding unbalance of said shutter in said shutter box caused by said hinges projecting from said shutter materials;

a projection height of said block from said shutter materials being the same height as a projection height of said hinges from said shutter materials such that said shutter winds evenly into said shutter box;

a bottom bar having the length to cover an entire width of said shutter;

both ends of said bottom bar being inserted into said guide rail;

said bottom bar fixedly attached at a lowest shutter material of said shutter; and a shock absorbing material mounted on said emergency exit such that said shock absorbing material is between said emergency exit and said shutter except where said shutter and said emergency exit are hingably connected when said emergency exit is in said closed position, whereby said shock absorbing material prevents smoke from leaking around a perimeter of said emergency exit.

2. A shutter apparatus for a building according to claim 1, wherein said means for correcting a winding unbalance includes blocks connected to said shutter materials having a projection height from said shutter materials equal to a projection height of said hinges such that both sides of said shutter roll into said shutter box at equal diameters.

3. A shutter apparatus for a building according to claim 1, wherein said means for preventing the slack displacement further includes:

an upper bar having a length covering said entire width of said shutter;

both ends of said upper bar being inserted into said guide rail; and said upper bar fixedly attached to a shutter material of said shutter upwardly adjacent to said emergency exit.

4. A shutter apparatus for a building according to claim 1, further including:

a stopper board having said shock-absorbing material, fixedly connected along an upper edge of said emergency exit for absorbing a shock caused by opening and shutting said emergency exit, intercepting smoke in case of fire, and reinforcing a strength of laid upper edge of said emergency exit.

5. A shutter apparatus for a building according to claim 1, further including:

a shock absorbing part for cutting off smoke formed at a right angle and connected to one end of said emergency exit;

a right angle portion of said shock absorbing part being at a right angle to a length of said emergency exit;

said right angle portion contacting said guide rail when said emergency exit is in said closed position;

said right angle portion including upper and lower extending portion extending above and below said shutter material such that said upper extending portion of said shock absorbing part mates with said lower extending portion of another shock absorbing part on an upwardly adjacent horizontal shutter material for preventing smoke from passing around said shutter.

6. A shutter apparatus for a building according to claim 1, wherein:

said bottom bar includes a horizontal groove;

said horizontal groove contains said shock absorbing material;

said shock absorbing material in said horizontal groove contacting a bottom edge of said emergency exit when said emergency exit is in said closed position to absorb shock and to decrease noise during shutting of said emergency exit, and to intercept smoke in case of fire.

7. A shutter apparatus comprising:

a plurality of vertically coupled shutter materials;

said plurality including shorter ones of Said plurality of shutter materials which are shorter than a remainder of said plurality of shutter materials;

an emergency exit attached to said shorter ones of said plurality of shutter materials by hinges;

a shutter box including means for winding said plurality of shutter materials around a drum in said shutter box;

means for preventing a winding unbalance including blocks attached between ends of said shorter ones of said plurality of shutter materials;

a projection height of said blocks out of said shutter corresponding to another projection height of said hinges such that said shutter winds evenly around said drum; and shock absorbing material placed where said emergency exit contacts said shutter whereby noise is reduced and smoke is prevented from infiltrating said shutter apparatus.

8. The shutter apparatus of claim 7, further including:

means for preventing a slack displacement including a bottom bar having the length to cover a width of said shutter apparatus;

both ends of said bottom bar inserted into said guide rail;

said bottom bar fixed to a lowest of said plurality of shutter materials of said shutter.

9. The shutter apparatus of claim 7, further including:

means for preventing the slack displacement including an upper bar having a length covering said entire width of said shutter apparatus;

both ends of said upper bar being inserted into said guide rail; and said upper bar fixedly attached to a shutter material of said shutter apparatus upwardly adjacent to said emergency exit.

10. A shutter apparatus of claim 7, further including:

a stopper board fixedly connected along an upper edge of said emergency exit for reinforcing a strength of said upper edge of said emergency exit.

11. The shutter apparatus of claim 7, further including:

a shock absorbing part for cutting off smoke formed at a right angle and connected to one end of said horizontal shutter material;

a right angle portion of said shock absorbing part being at a right angle to a length of said horizontal shutter material;

said right angle portion inserted in said guide rail;

said right angle portion including upper and lower extending portion extending above and below said shutter material such that said upper extending portion of said shock absorbing part mates with said lower extending portion of another shock absorbing part on an upwardly adjacent horizontal shutter material for preventing smoke from passing around said shutter.

12. The shutter apparatus of claim 7, wherein:

lowest of said shutter materials includes a horizontal groove;

said horizontal groove contains said shock absorbing material;

said shock absorbing material in said horizontal groove contacting a bottom edge of said emergency exit when said emergency exit is in said closed position to absorb shock and to decrease noise during shutting of said emergency exit, and to intercept smoke in case of fire.

13. A shutter apparatus comprising:

a shutter having a plurality of vertically coupled horizontal shutter materials, each of said horizontal shutter materials having equal top and bottom widths;

a shutter box equipped with the means for winding said shutter into and out of said shutter box;

a guide rail set up at both sides of said shutter and guiding an ascent and descent motion of said shutter;

said plurality of vertically coupled horizontal shutter materials including shorter ones of said plurality of vertically coupled shutter materials which are shorter than a remainder of said plurality of vertically coupled shutter materials;

an emergency exit attached to an end of said shorter ones of said plurality of vertically coupled shutter materials by hinges;

said hinges connecting said emergency exit to said end of said shorter ones of said plurality of vertically coupled shutter materials such that said emergency exit pivots about said hinges between an open position and closed position;

at least one block attached between said hinges and another end of said shorter ones of said vertically coupled shutter materials to correct a winding unbalance of said shutter in said shutter box caused by said hinges projecting from said shutter; and a projection height of said at least one block being the same height as a projection height of said hinges from said shutter such that said shutter winds evenly into said shutter box.

* * * * *